US011317487B1

(12) United States Patent
Chang et al.

(10) Patent No.: US 11,317,487 B1
(45) Date of Patent: Apr. 26, 2022

(54) DRIVING DEVICE, CONTROL METHOD OF DRIVING DEVICE AND LIGHTING SYSTEM

(71) Applicant: Coretronic Corporation, Hsin-Chu (TW)

(72) Inventors: Wen-Hsin Chang, Hsin-Chu (TW); Shun-Tai Chen, Hsin-Chu (TW); Chung-Lin Ke, Hsin-Chu (TW); Yi-Yuan Peng, Hsin-Chu (TW)

(73) Assignee: Coretronic Corporation, Hsin-Chu (TW)

( * ) Notice: Subject to any disclaimer, the term of this patent is extended or adjusted under 35 U.S.C. 154(b) by 0 days.

(21) Appl. No.: 17/243,585

(22) Filed: Apr. 29, 2021

(30) Foreign Application Priority Data

Feb. 25, 2021 (TW) ..... 110106623

(51) Int. Cl.
*H05B 45/32* (2020.01)
*H05B 45/345* (2020.01)

(52) U.S. Cl.
CPC ..... *H05B 45/32* (2020.01); *H05B 45/345* (2020.01)

(58) Field of Classification Search
None
See application file for complete search history.

(56) References Cited

U.S. PATENT DOCUMENTS 10,292,227 B1 * 5/2019 Moumen ..... H05B 47/155
2013/0334980 A1 * 12/2013 Zhou ..... H05B 47/185 315/250

FOREIGN PATENT DOCUMENTS

| | | |
|---|---|---|
| CN | 102576978 | 7/2012 |
| TW | 201142567 | 12/2011 |
| TW | I628976 | 7/2018 |

OTHER PUBLICATIONS

"Office Action of Taiwan Counterpart Application", dated Dec. 15, 2021, p. 1-p. 9.

* cited by examiner

*Primary Examiner* — Jany Richardson
(74) *Attorney, Agent, or Firm* — JCIPRNET

(57) ABSTRACT

A driving device is provided. The driving device includes a signal processing circuit and a driving circuit. The signal processing circuit is configured to generate a current input signal according to a target current signal. The driving circuit is configured to receive the current input signal and generate a current output signal according to the current input signal to drive a light emitting element. In a first time interval, the current input signal gradually rises from a first current value to a target current value in a continuous or segmented manner according to a rising slope. Further, a control method of the driving device and a lighting system including the driving device are also provided.

15 Claims, 5 Drawing Sheets

DRIVING DEVICE, CONTROL METHOD OF DRIVING DEVICE AND LIGHTING SYSTEM

CROSS-REFERENCE TO RELATED APPLICATION

This application claims the priority benefit of Taiwanese application no. 110106623, filed on Feb. 25, 2021. The entirety of the above-mentioned patent application is hereby incorporated by reference herein and made a part of this specification.

BACKGROUND

Technical Field

The disclosure relates to a driving device of a light emitting element; particularly, the disclosure relates to a driving device that adjusts a driving waveform.

Description of Related Art

The current mainstream projection devices use light-emitting diodes or laser as light sources. Light sources of such a type are of high brightness, high performance, and wide color gamut. However, in a light source of the above type, light emitting efficiency is subject to a body temperature. Specifically, a temperature of a light emitting element body is relatively low when the light emitting element of the light source of above type has just been driven. At this time, the light emitting efficiency of the light emitting element is higher than at a relatively high temperature.

FIG. 1 is a schematic diagram showing comparison between light emitting efficiency of a light source and a temperature change. With reference to FIG. 1, a driving signal Id configured to drive the light emitting element of the light source of the above type is exhibited in a flat square wave, and the light emitting element of the light source of the above type is driven by the driving signal Id to generate an optical output waveform I_opt. As shown therein, since the temperature of the light emitting element body is relatively low in the initial driving phase, the light emitting element has a higher light emitting efficiency and overshoot occurs in the generated optical output waveform I_opt in a time interval t1. Therefore, a case is possible where a power generated by the light emitting element exceeds a rated maximum output power (also referred to as a fixed wattage of the light emitting element). The overshoot disappears when the temperature of the light emitting element body rises, such that the optical output waveform I_opt is exhibited in a waveform corresponding to the driving signal Id after the time interval t1. The overshoot reduces the life of the light emitting element. In the case where the light source only requires to be turned on once for maintaining a fixed waveform, impacts of the overshoot on the life of the light emitting element may still be acceptable. However, in the case where the light source requires to be frequently turned on and off (e.g., being driven in a pulse mode), the life of the light emitting element will be greatly reduced.

Generally speaking, in order to prevent exceeding the rated maximum output power of the light emitting element due to the overshoot, lowering a stable current point of DC current (i.e., reducing an intensity of driving current) may be adopted. However, this reduces brightness generated by the light source and thus competitiveness of the product. Therefore, it is required to propose a solution to prevent overshoot in the optical output waveform while taking brightness of the light source into account.

The information disclosed in this Background section is only for enhancement of understanding of the background of the described technology and therefore it may contain information that does not form the prior art that is already known to a person of ordinary skill in the art. Further, the information disclosed in the Background section does not mean that one or more problems to be resolved by one or more embodiments of the invention was acknowledged by a person of ordinary skill in the art.

SUMMARY

The disclosure provides a driving device that prevents overshoot in an optical output waveform while taking brightness of a light source into account.

In order to achieve one, some, or all of the above objectives or other objectives, an embodiment of the disclosure proposes a driving device. The driving device includes a signal processing circuit and a driving circuit. The signal processing circuit is configured to generate a current input signal according to a target current signal. The driving circuit is configured to receive the current input signal and generate a current output signal according to the current input signal to drive a light emitting element. The current input signal gradually rises from a first current value to a target current value in a continuous or segmented manner according to a rising slope during a first time interval.

In order to achieve one, some, or all of the above objectives or other objectives, an embodiment of the disclosure proposes a driving device. The driving device includes a driving circuit and a buffer circuit. The driving circuit is configured to receive a current input signal and generate a current output signal according to the current input signal to drive a light emitting element. The buffer circuit is coupled between the driving circuit and the light emitting element, such that the current output signal gradually rises to a target current value during a first time interval.

In order to achieve one, some, or all of the above objectives or other objectives, an embodiment of the disclosure proposes a lighting system. The lighting system includes a light emitting element and a driving device. The driving device is coupled to the light emitting element. The driving device includes a signal processing circuit and a driving circuit. The signal processing circuit is configured to generate a current input signal according to a target current signal. The driving circuit is configured to receive the current input signal and generate a current output signal according to the current input signal to drive the light emitting element. The current input signal gradually rises from a first current value to a target current value in a continuous or segmented manner according to a rising slope during a first time interval.

In order to achieve one, some, or all of the above objectives or other objectives, an embodiment of the disclosure proposes a control method of a driving device. The control method includes the following. A current input signal is generated by a signal processing circuit of the driving device according to a target current signal. The current input signal is received and a current output signal is generated according to the current input signal by the driving circuit of the driving device to drive a light emitting element. The current input signal gradually rises from a first current value to a target current value in a continuous or segmented manner according to a rising slope during a first time interval.

In order to achieve one, some, or all of the above objectives or other objectives, an embodiment of the disclosure proposes a control method of a driving device. The control method includes the following. A current input signal is received and a current output signal is generated according to the current input signal by a driving circuit of the driving device to drive a light emitting element. A buffer circuit is coupled between the driving circuit and the light emitting element, such that the current output signal gradually rises to a target current value during a first time interval.

Based on the foregoing, the embodiments of the disclosure have at least one of following advantages or effects. In the disclosure, in the first time interval after the driving is initiated, the current input signal (or current output signal) is increased from a current value lower than the target current value to the target current value. In this way, overshoot in the optical output waveform due to the low temperature of the light emitting element body in the initial driving phase is prevented. At the same time, the brightness of the light emitting element is maintained at the desired brightness. In addition, since the power generated by the light emitting element does not exceed the rated maximum output power, the life of the light emitting element is also prolonged.

Other objectives, features and advantages of the present invention will be further understood from the further technological features disclosed by the embodiments of the present invention wherein there are shown and described preferred embodiments of this invention, simply by way of illustration of modes best suited to carry out the invention.

To make the aforementioned more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
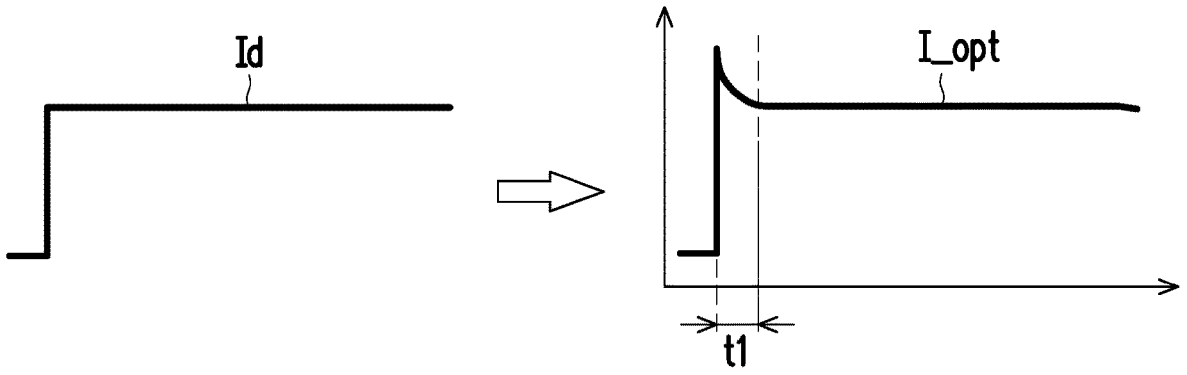
FIG. 1 is a schematic diagram showing comparison between light emitting efficiency of a light source and a temperature change.
Figure 2:
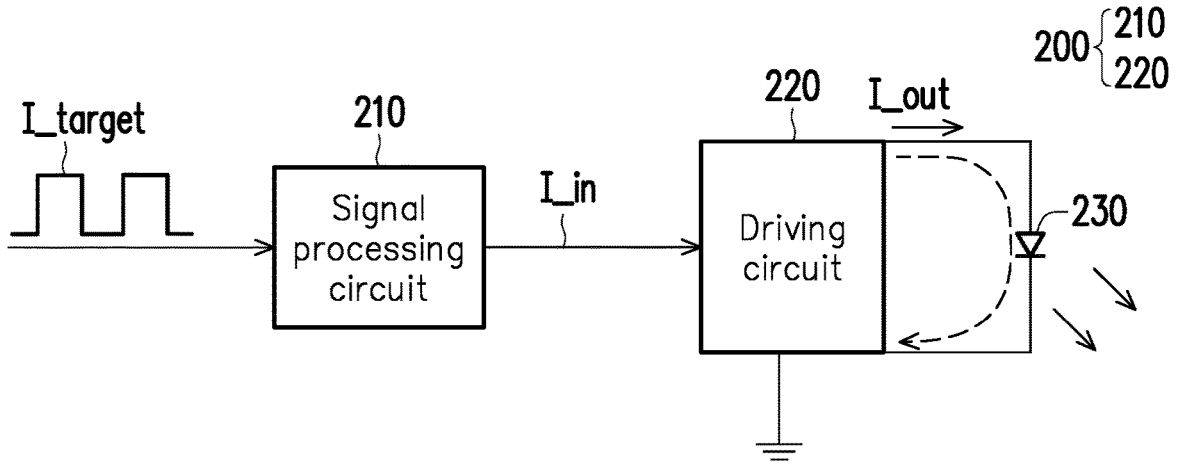
FIG. 2 is a block diagram of a lighting system including a driving device of a light source according to an embodiment of the disclosure.

FIG. 2 is a block diagram of a lighting system including a driving device of a light source according to an embodiment of the disclosure. With reference to FIG. 2, the lighting system includes a driving device 200 and a light emitting element 230. The driving device 200 includes a signal processing circuit 210 and a driving circuit 220. The signal processing circuit 210 may be an analog signal processor configured to generate a current input signal I_in according to a target current signal I_target. In this embodiment, the target current signal I_target may be a preset target current and is recorded in a processor, and the processor sends a preset signal. The driving circuit 220 is configured to receive the current input signal I_in and generate a current output signal I_out according to the current input signal I_in to drive the light emitting element 230. In a first time interval, the current input signal I_in gradually rises from a first current value to a target current value in a continuous or segmented manner according to a rising slope during the first time interval. Hereinafter, correspondence between multiple current input signals and optical output waveforms will be described with FIG. 3A to FIG. 3C.

Figure 3A:
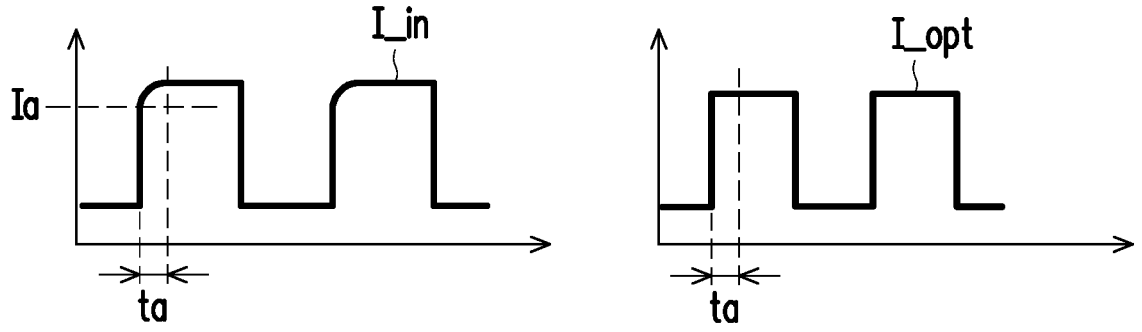
FIG. 3A is a schematic diagram showing comparison between a current input signal and an optical output waveform according to an embodiment of the disclosure.

FIG. 3A is a schematic diagram showing comparison between a current input signal and an optical output waveform according to an embodiment of the disclosure. With reference to FIG. 2 and FIG. 3A together, in a time interval ta (initial driving phase), the current input signal I_in starts to rise from a current value Ia lower than a target current value according to an exponential rising slope, to offset an exponential overshoot in the optical output waveform I_opt, and reaches the target current value at the end of the time interval ta. Notably, since the driving circuit 220 is a closed-loop system (see the dashed arrow as shown in FIG. 2), the current output signal I_out generated by the driving circuit 220 faithfully reflects the current waveform of the current input signal I_in. Since the temperature of the light emitting element body is relatively low in the initial driving phase, the light emitting element 230 has a higher light emitting efficiency, and overshoot occurs in the generated optical output waveform I_opt in the time interval ta. The optical output waveform I_opt may be measured from both ends of the light emitting element 230 through a current probe, and may also be measured from the outside (e.g., places where the light path passes) through an optical sensing instrument. In addition, the term "temperature" used in the disclosure refers to the temperature of (internal to) the light emitting element body, instead of the temperature of the overall lighting system.

Since the current input signal I_in (the current value Ia) is lower than the target current value in the initial driving phase, even if overshoot occurs in the optical output waveform I_opt, it would not cause an output power to exceed a rated maximum output power for the light emitting element 230. Moreover, with the combination of the exponential rising slope and the temperature change, the light emitting element 230 is consistently maintained at the desired brightness from the beginning. As shown in FIG. 3A, the optical output waveform I_opt therein is exhibited in a square wave.

Figure 3B:
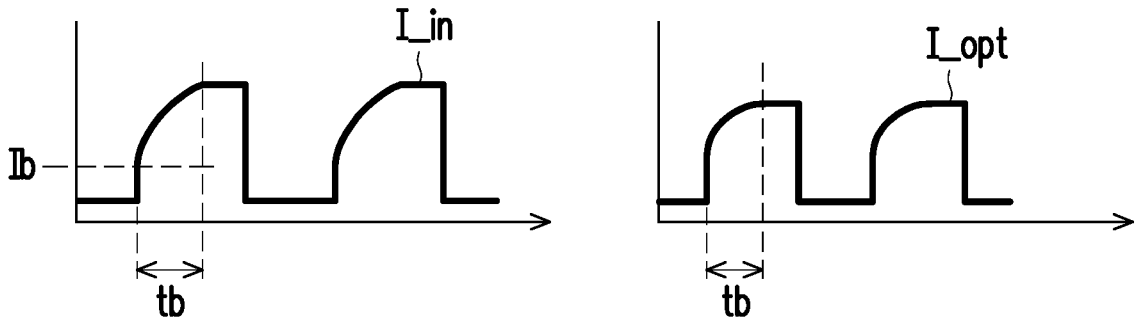
FIG. 3B is a schematic diagram showing comparison between a current input signal and an optical output waveform according to an embodiment of the disclosure.

FIG. 3B is a schematic diagram showing comparison between a current input signal and an optical output waveform according to an embodiment of the disclosure. Similarly, in FIG. 3B, in a time interval tb (initial driving phase), the current input signal I_in starts to rise from a current value Ib lower than a target current value according to a curvilinear rising slope, and reaches the target current value at the end of the time interval tb. As shown therein, a brightness of the generated optical output waveform I_opt in the time interval tb is slightly reduced and does not reach the desired brightness. That is to say, in terms of the power supply brightness in the initial driving phase, the brightness presented by the optical output waveform I_opt as shown in FIG. 3B is lower than the desired brightness. However, after the time interval tb, the optical output waveform I_opt is consistently maintained at the desired brightness.

Figure 3C:
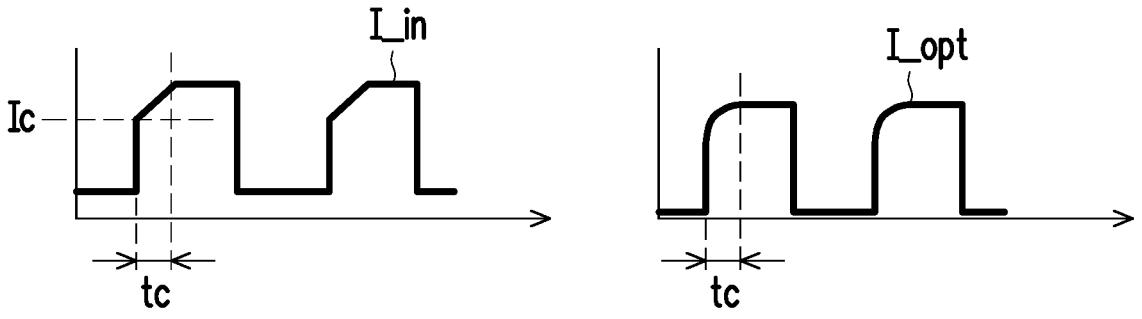
FIG. 3C is a schematic diagram showing comparison between a current input signal and an optical output waveform according to an embodiment of the disclosure.

FIG. 3C is a schematic diagram showing comparison between a current input signal and an optical output waveform according to an embodiment of the disclosure. Similarly, in FIG. 3C, in a time interval tc (initial driving phase), the current input signal I_in starts to rise from a current value Ic lower than a target current value according to a linear rising slope, and reaches the target current value at the end of the time interval tc. As shown therein, a brightness of the generated optical output waveform I_opt in the time interval tc is slightly reduced and does not reach the desired brightness. That is to say, in terms of the power supply brightness in the initial driving phase, the brightness presented by the optical output waveform I_opt as shown in FIG. 3C is lower than the desired brightness. However, after the time interval tc, the optical output waveform I_opt is consistently maintained at the desired brightness.

Figure 4:
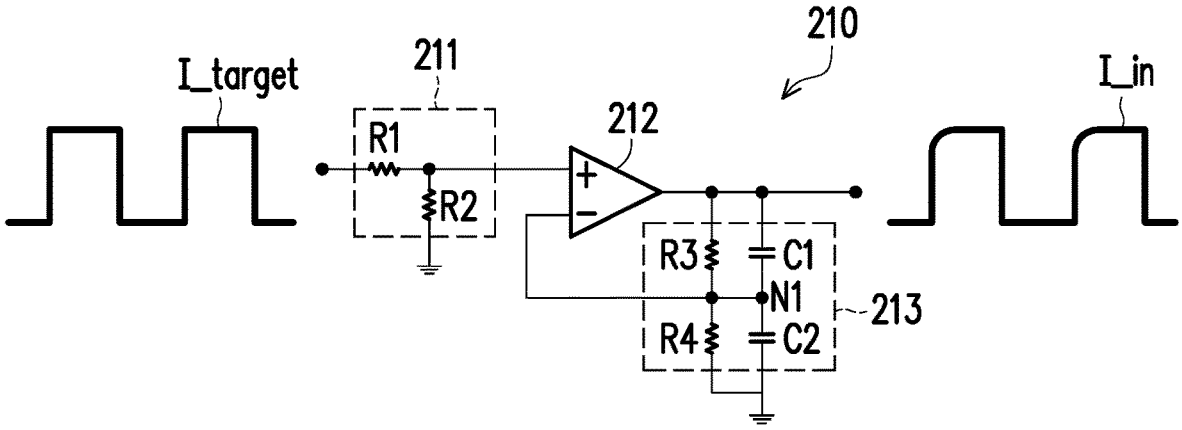
FIG. 4 is a schematic circuit diagram of a signal processing circuit according to an embodiment of the disclosure.

FIG. 4 is a schematic circuit diagram of a signal processing circuit according to an embodiment of the disclosure. With reference to FIG. 2 and FIG. 4 together, the signal processing circuit 210 is configured to receive the target current signal I_target with a target current value, and transmit the generated current input signal I_in to the driving circuit 220. The signal processing circuit 210 includes a voltage divider circuit 211, an amplifier 212, and a resonant circuit 213. The voltage divider circuit 211 may be composed of resistors R1 and R2 and be configured to receive the target current signal I_target to generate a voltage-dividing result. An initial value of the current input signal I_in is determined through the voltage-dividing result. The voltage divider circuit 211 may perform a conversion of the current input signal I_in. A first end of the resistor R1 receives the target current signal I_target. A second end of the resistor R1 is coupled to a first end of the resistor R2, and a second end of the resistor R2 is coupled to an end of a reference ground voltage. A non-inverting input end of the amplifier 212 is coupled to the second end of the resistor R1 (i.e., the first end of the resistor R2) to receive the voltage-dividing result. An inverting input end of the amplifier 212 is coupled to a node N1. An output end of the amplifier 212 generates the current input signal I_in.

In an embodiment, the signal processing circuit 210 includes the amplifier 212 and the resonant circuit 213 and does not include the voltage divider circuit 211. The target current signal I_target is received by the non-inverting input end of the amplifier 212.

The resonant circuit 213 is coupled between the inverting input end of the amplifier 212 and the output end of the amplifier 212 and is configured to determine an exponential rising slope. The resonant circuit 213 includes a resistor R3, a resistor R4, a capacitor C1, and a capacitor C2. The capacitor C1 is coupled between the output end of the amplifier 212 and the node N1. The capacitor C2 is coupled between the node N1 and the end of the reference ground voltage. The resistor R3 and the resistor R4 are connected in series. A first end of the resistor R3 is coupled to the output end of the amplifier 212, and a second end of the resistor R3 is coupled to a first end of the resistor R4. A second end of the resistor R4 is coupled to the end of the reference ground voltage. Through configuring a resistance of the resistors R3 and R4 and configuring a capacitance of the capacitors C1 and C2, a duration for which the current input signal I_in rises from the initial value to the target current value and the exponent according to which the rising slope rises may be determined. With the structure as shown in FIG. 4, the signal processing circuit 210 may generate the current input signal I_in that rises according to an exponential rising slope in the initial driving phase as shown in FIG. 3A. By increasing the capacitance of C1, the rising slope of the current input signal I_in is suppressed and a waveform such as the current input signal I_in as shown in FIG. 3C is formed.

Figure 5:
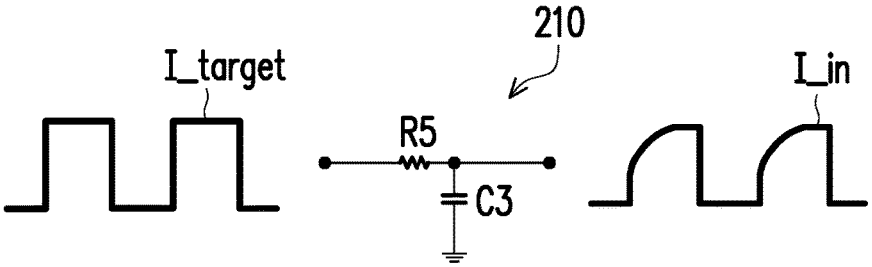
FIG. 5 is a schematic circuit diagram of a signal processing circuit according to an embodiment of the disclosure.

FIG. 5 is a schematic circuit diagram of a signal processing circuit according to an embodiment of the disclosure. With reference to FIG. 2 and FIG. 5 together, the signal processing circuit 210 is configured to receive the target current signal I_target with a target current value, and transmit the generated current input signal I_in to the driving circuit 220. The signal processing circuit 210 includes a resistor R5 and a capacitor C3. A first end of the resistor R5 receives the target current signal I_target, and a second end of the resistor R5 generates the current input signal I_in. The capacitor C3 is coupled between the second end of the resistor R5 and an end of a reference ground voltage. Therefore, under the structure as shown in FIG. 5, the signal processing circuit 210 may generate the current input signal I_in that rises according to a curvilinear rising slope (depending on the charging speed of the capacitor C3) in the initial driving phase as shown in FIG. 3B.

Generally speaking, a duration for which the temperature of the light emitting element body rises, when being driven, from a relatively low temperature to a relatively high temperature is about 1 millisecond to 2 milliseconds. Therefore, through the circuit design of the signal processing circuit 210, a duration of the time intervals (e.g., the time intervals ta, tb, and tc as shown in FIG. 3A to FIG. 3C) may be less than or equal to 3 milliseconds. In addition, a strength of the current input signal I_in in the initial driving phase (the current values Ia, Ib, and Ic as shown in FIG. 3A to FIG. 3C) may be designed to be greater than or equal to 60% of the target current value (e.g., 1 ampere) and less than or equal to 95% of the target current value.

However, the above examples should not pose limitations on the disclosure, and those skilled in the art should be able to determine the duration of the time interval and the initial value of the current input signal I_in through circuit designs without departing from the core spirit of the disclosure. In an embodiment, it may be designed that the duration of the time interval is 1 millisecond, and the initial value of the current input signal I_in is a value between 70% of the target current value and 93% of the target current value. In an embodiment, the initial value of the current input signal I_in may be a value between 80% of the target current value and 90% of the target current value. To summarize, according to the structure and property of the light emitting element (e.g., the heating rate, relevant to the heat dissipation capability of the light emitting element) and depending on the overshoot in the optical output waveform I_opt, those skilled in the art may determine the duration of the time interval, the initial value of the current input signal I_in, and the rising slope (e.g., the exponential, curvilinear, or linear rising slope as shown in FIG. 3A to FIG. 3C).

In the foregoing embodiments, the various waveforms of the current input signal I_in are generated using an analog signal processor. However, those skilled in the art may also generate the various waveforms of the desired current input signal I_in directly using a digital signal processor (DSP). In other words, the signal processing circuit 210 may also include a digital signal processor, which is a specialized microprocessor for digital signal processing, and may be programmed to process signals. The digital signal processor may receive the target current signal I_target and perform operations to generate the various waveforms of the current input signal I_in (as shown in FIG. 3A to FIG. 3C). For example, the functionality of the voltage divider circuit 211, the amplifier 212, and the resonant circuit 213 of FIG. 4 may be realized by a digital signal processor (DSP).

Figure 6:
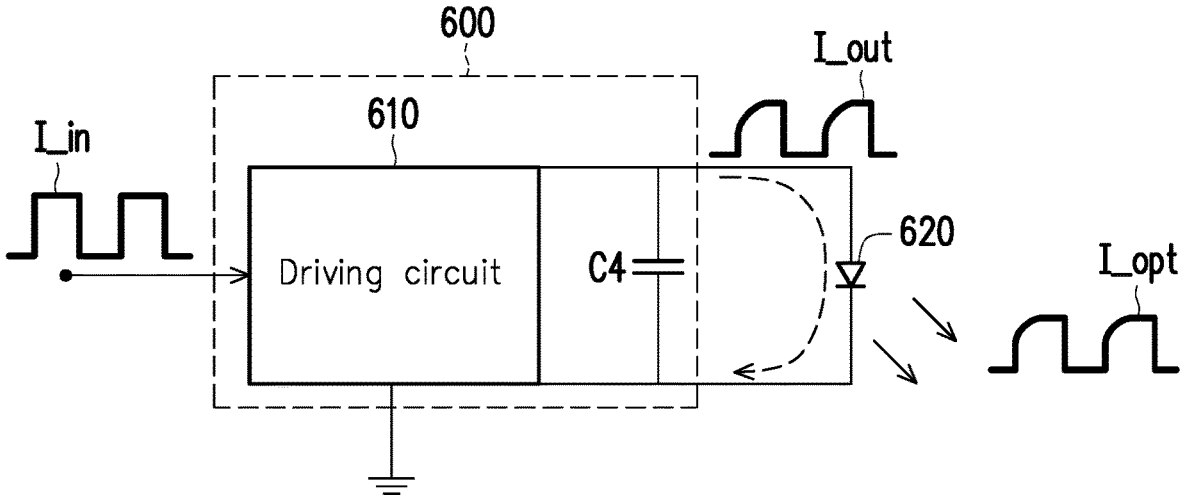
FIG. 6 is a block diagram of a driving device of a light source according to an embodiment of the disclosure.

FIG. 6 is a block diagram of a driving device of a light source according to an embodiment of the disclosure. With reference to FIG. 6, a driving device 600 includes only a driving circuit 610 and a buffer circuit and does not include a signal processing circuit. The buffer circuit may be coupled between a first end and a second end of the driving circuit 610. The buffer circuit is capable of slowing down the rising speed of the current output signal I_out in the initial driving phase. In this embodiment, the buffer circuit may include a capacitor C4 (with a relatively large capacitance, e.g., 6.8 uF, of which an approximate capacitance may also be obtained using a combination of three capacitors of 2.2 uF). A first end of a light emitting element 620 is coupled to the first end of the driving circuit 610, and a second end of the light emitting element 620 is coupled to the second end of the driving circuit 610. On the other hand, the capacitor C4 is connected in parallel to the light emitting element 620. The driving circuit 610 receives the current input signal I_in that is equivalent to the target current signal to generate the corresponding current output signal I_out. The capacitor C4 is coupled between the driving circuit 610 and the light emitting element 620, such that in a time interval, the current output signal I_out gradually rises to a target current value. Specifically, the current output signal I_out generated by the driving circuit 610 is affected by the charging speed of the capacitor C4, such that the brightness presented by the optical output waveform I_opt in the initial driving phase is lower than the desired brightness. However, after charging of the capacitor C4 is complete, the optical output waveform I_opt is consistently maintained at the desired brightness.

Figure 7:
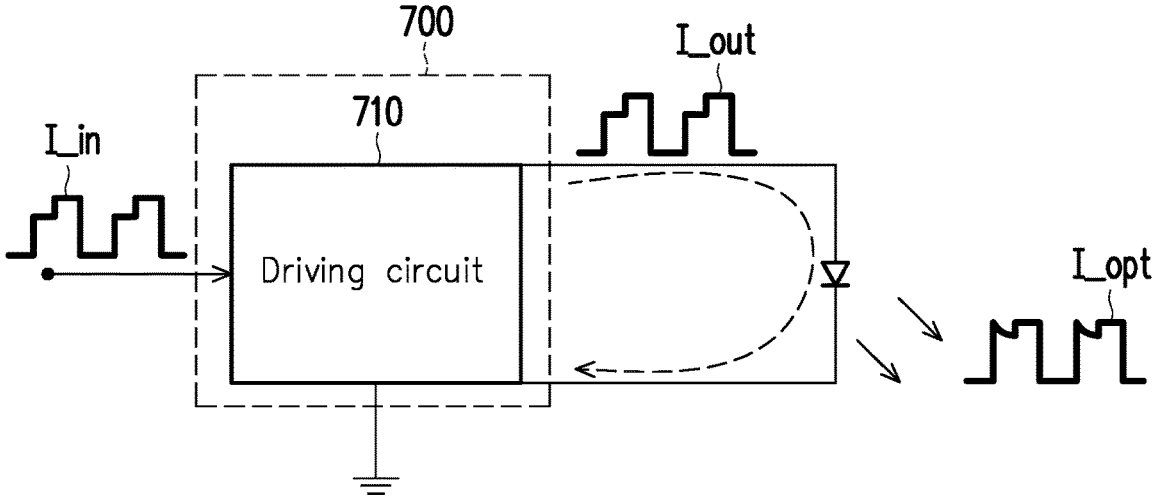
FIG. 7 is a block diagram of a driving device of a light source according to an embodiment of the disclosure.

FIG. 7 is a block diagram of a driving device of a light source according to an embodiment of the disclosure. With reference to FIG. 7, a driving device 700 of this embodiment may include a driving circuit 710. The driving circuit 710 is configured to receive the current input signal I_in and generate the current output signal I_out according to the current input signal I_in. In this embodiment, in the initial driving phase, the current input signal I_in rises in segments from a current value lower than a target current value to the target current value. For example, the initial value of the current input signal I_in is 80% of the target current value (e.g., 800 mA). After being maintained for a period of time, the current input signal I_in is changed to the target current value (e.g., 1 ampere). Notably, although FIG. 7 only exemplifies that the change of the current input signal I_in has two phases, the disclosure is not limited thereto. In other embodiments, the change of the current input signal I_in has three or more phases. The current input signal I_in that rises in segments may be realized by a customized chip. Similarly, although the brightness presented by the optical output waveform I_opt in the initial driving phase is lower than the desired brightness, afterward, it is consistently maintained at the desired brightness.

Figure 8:
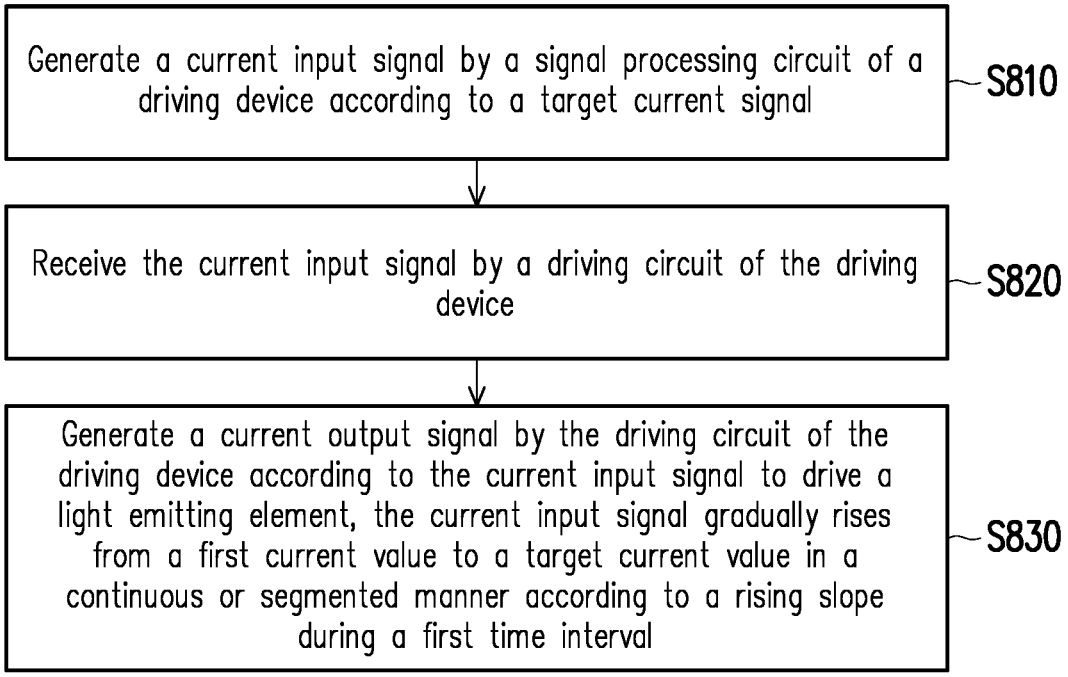
FIG. 8 is a flowchart showing steps of a control method of a driving device according to an embodiment of the disclosure.

FIG. 8 is a flowchart showing steps of a control method of a driving device according to an embodiment of the disclosure. With reference to FIG. 2 and FIG. 8 together, in step S810, the signal processing circuit 210 of the driving device 200 generates the current input signal I_in according to the target current signal I_target. In step S820, the driving circuit 220 of the driving device 200 receives the current input signal I_in. In step S830, the driving circuit 220 of the driving device 200 generates the current output signal I_out according to the current input signal I_in to drive the light emitting element 230. In a first time interval, the current input signal I_in gradually rises from a first current value (e.g., Ia, Ib and Ic as shown in FIG. 3A to FIG. 3C) to a target current value in a continuous or segmented manner according to a rising slope during the first time interval.

Figure 9:
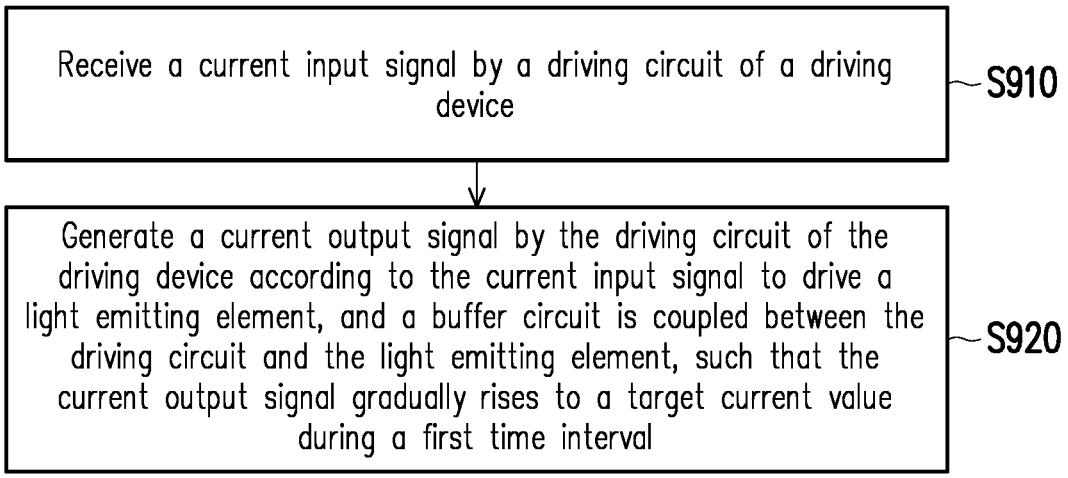
FIG. 9 is a flowchart showing steps of a control method of a driving device according to an embodiment of the disclosure.

FIG. 9 is a flowchart showing steps of a control method of a driving device according to an embodiment of the disclosure. With reference to FIG. 6 and FIG. 9 together, in step S910, the driving circuit 610 of the driving device 600 receives the current input signal I_in. In step S920, the driving circuit 610 of the driving device 600 generates the current output signal I_out according to the current input signal I_in to drive the light emitting element 620. A buffer circuit (e.g., the capacitor C4 as shown in FIG. 6) is coupled between the driving circuit 610 and the light emitting element 620, such that in a first time interval, the current output signal I_out gradually rises to a target current value during the first time interval.

In summary of the foregoing, the embodiments of the disclosure have at least one of the following advantages or effects. The core spirit of the disclosure lies in that, in the initial driving phase, a drive current signal (e.g., the current output signal I_out as shown in FIG. 2 and FIG. 6) lower than the target current value is provided to the light emitting element, and the drive current signal is caused to rise to the target current value within a period of time. In this way, even if overshoot occurs in the optical output waveform due to the low temperature of the light emitting element body in the initial driving phase, the power generated by the light emitting element would not exceed the rated maximum output power, thus prolonging the life of the light emitting element. Furthermore, the brightness of the light emitting element is maintained consistent during the overall driving phase.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A driving device, comprising:

a signal processing circuit, configured to generate a current input signal according to a target current signal; and a driving circuit, configured to receive the current input signal and generate a current output signal according to the current input signal to drive a light emitting element, wherein the current input signal gradually rises from a first current value to a target current value in a continuous or segmented manner according to a rising slope during a first time interval, wherein the signal processing circuit comprises:

a resistor, wherein a first end of the resistor receives the target current signal, and a second end of the resistor generates the current input signal; and a capacitor, coupled between the second end of the resistor and an end of a reference ground voltage.

2. The driving device according to claim 1, wherein a duration of the first time interval is less than or equal to 3 milliseconds.

3. The driving device according to claim 1, wherein the first current value is greater than or equal to 60% of the target current value and less than or equal to 95% of the target current value.

4. A driving device, comprising:

a signal processing circuit, configured to generate a current input signal according to a target current signal; and a driving circuit, configured to receive the current input signal and generate a current output signal according to the current input signal to drive a light emitting element, wherein the current input signal gradually rises from a first current value to a target current value in a continuous or segmented manner according to a rising slope during a first time interval, wherein the signal processing circuit comprises:

an amplifier, wherein a non-inverting input end of the amplifier receives the target current signal, and an output end of the amplifier generates the current input signal; and a resonant circuit, configured to determine the rising slope, wherein a first end of the resonant circuit is coupled to an inverting input end of the amplifier, a second end of the resonant circuit is coupled to the output end of the amplifier, and a third end of the resonant circuit is coupled to an end of a reference ground voltage.

5. The driving device according to claim 4, wherein the resonant circuit comprises:

a first resistor, wherein a first end of the first resistor is coupled to the output end of the amplifier;

a second resistor coupled between a second end of the first resistor and the end of the reference ground voltage;

a first capacitor, wherein a first end of the first capacitor is coupled to the output end of the amplifier; and a second capacitor coupled between a second end of the first capacitor and the end of the reference ground voltage, wherein the output end of the amplifier is coupled to the second end of the first resistor and the second end of the first capacitor.

6. A driving device, comprising:

a signal processing circuit, configured to generate a current input signal according to a target current signal; and a driving circuit, configured to receive the current input signal and generate a current output signal according to the current input signal to drive a light emitting element, wherein the current input signal gradually rises from a first current value to a target current value in a continuous or segmented manner according to a rising slope during a first time interval, and the signal processing circuit is a digital signal processor configured to receive the target current signal and perform adjustment according to the target current signal to generate the current input signal.

7. A driving device, comprising:

a driving circuit, configured to receive a current input signal and generate a current output signal according to the current input signal to drive a light emitting element; and a buffer circuit, coupled between the driving circuit and the light emitting element, such that the current output signal gradually rises to a target current value during a first time interval, wherein the buffer circuit comprises a capacitor, and the capacitor is connected in parallel with the light emitting element.

8. A lighting system, comprising:

a light emitting element; and a driving device coupled to the light emitting element, wherein the driving device comprises:

a signal processing circuit, configured to generate a current input signal according to a target current signal, and the signal processing circuit comprises:

a resistor, wherein a first end of the resistor receives the target current signal, and a second end of the resistor generates the current input signal; and a capacitor, coupled between the second end of the resistor and an end of a reference ground voltage; and a driving circuit, configured to receive the current input signal and generate a current output signal according to the current input signal to drive the light emitting element, wherein the current input signal gradually rises from a first current value to a target current value in a continuous or segmented manner according to a rising slope during a first time interval.

9. A control method of a driving device, wherein the driving device comprises a signal processing circuit and a driving circuit, the signal processing circuit comprises a resistor and a capacitor, and the control method comprises:

generating a current input signal by a second end of the resistor of the signal processing circuit according to a target current signal received by a first end of the resistor; and receiving the current input signal and generating a current output signal according to the current input signal by the driving circuit to drive a light emitting element, wherein the current input signal gradually rises from a first current value to a target current value in a continuous or segmented manner according to a rising slope during a first time interval, and the capacitor coupled between the second end of the resistor and an end of a reference ground voltage.

10. The control method according to claim 9, wherein the signal processing circuit comprises an amplifier and a resonant circuit, and the control method further comprises:

receiving the target current signal by a non-inverting input end of the amplifier, and generating the current input signal by an output end of the amplifier; and determining the rising slope by the resonant circuit, wherein a first end of the resonant circuit is coupled to an inverting input end of the amplifier, a second end of the resonant circuit is coupled to the output end of the amplifier, and a third end of the resonant circuit is coupled to an end of a reference ground voltage.

11. The control method according to claim 10, wherein the resonant circuit comprises a first resistor, a second resistor, a first capacitor, and a second capacitor, wherein a first end of the first resistor is coupled to the output end of the amplifier;

the second resistor is coupled between a second end of the first resistor and the end of the reference ground voltage;

a first end of the first capacitor is coupled to the output end of the amplifier;

the second capacitor is coupled between a second end of the first capacitor and the reference ground voltage; and the output end of the amplifier is coupled to the second end of the first resistor and the second end of the first capacitor.

12. The control method according to claim 9, wherein the signal processing circuit is a digital signal processor, and the control method further comprises:

receiving the target current signal and performing adjustment according to the target current signal by the digital signal processor to generate the current input signal.

13. The control method according to claim 9, wherein a duration of the first time interval is less than or equal to 3 milliseconds.

14. The control method according to claim 9, wherein the first current value is greater than or equal to 60% of the target current value and less than or equal to 95% of the target current value.

15. A control method of a driving device, wherein the driving device comprises a driving circuit and a buffer circuit, and the control method comprises:

receiving a current input signal and generating a current output signal according to the current input signal by the driving circuit to drive a light emitting element, wherein the buffer circuit is coupled between the driving circuit and the light emitting element, such that the current output signal gradually rises to a target current value during a first time interval, and the buffer circuit comprises a capacitor, and the capacitor is connected in parallel with the light emitting element.

* * * * *